United States Patent [19]

Honeyman, III

[11] Patent Number: 4,873,848

[45] Date of Patent: Oct. 17, 1989

[54] LOCKING SYSTEM FOR SECURING VALUABLES

[76] Inventor: Henry W. Honeyman, III, 118 Peninsula Rd., Matunuck Point, Wakefield, R.I. 02879

[21] Appl. No.: 302,934

[22] Filed: Jan. 30, 1989

[51] Int. Cl.[4] ..... E05B 73/00

[52] U.S. Cl. ..... 70/14; 70/58

[58] Field of Search ..... 70/2, 6–13, 70/14, 58, 57, 61, 59; 292/281; 24/235, 234, 116 R, 599; 114/230

[56] References Cited

U.S. PATENT DOCUMENTS

| | | | |
|---|---|---|---|
| 283,464 | 8/1883 | Brown | 24/234 |
| 1,429,334 | 9/1922 | Furber | 70/14 |
| 3,081,056 | 3/1963 | Young | 70/61 |
| 3,105,280 | 10/1963 | Davis | 24/234 |
| 3,194,598 | 7/1965 | Goldfuss | 24/235 |
| 4,596,334 | 6/1986 | Daulton | 70/61 |

*Primary Examiner*—Robert L. Wolfe

*Attorney, Agent, or Firm*—Barlow & Barlow, Ltd.

[57] ABSTRACT

A device for securing a boat against unauthorized use is formed of a U shaped hasp with a slot for the reception of a latch lug that is pivoted to the U shaped hasp. The lug has an aperture for the reception of a padlock is preferably sized or provided with an enlargement to prevent the lug from being withdrawn in the direction of the aperture.

6 Claims, 1 Drawing Sheet

LOCKING SYSTEM FOR SECURING VALUABLES

BACKGROUND AND SUMMARY OF THE INVENTION

Floating boats and some small motorized carts are constantly subjected to the danger of being used by unauthorized persons. For example, the usual means of securing a boat to a wharf or a float is by means of a rope that is then tied about a cleat or a bit or a pile on the wharf. Rope can be easily untied or even cut by an ordinary knife and it is therefore desirable to provide a system wherein a higher security can be provided. In my prior patent, U.S. Pat. No. 3,101,695, I suggested a device for securing a boat or the like which utilized wire with sleeves clamped on the wire. Unfortunately,it has been found that wire corrodes badly and can be more readily cut than some other materials and it is desirable, therefore, to utilize forged chain. Further it is more acceptable to use existing eyes and the like rather than fastening a special fitting to a boat that has only one purpose.

The instant invention provides hasp-like devices which are adapted to receive a padlock. The hasp-like devices are uniquely designed by being bent in U shape to receive readily a link of a chain or other securing means such as the bow eye of a small boat while a spring-loaded latch lug is hingedly arranged on the hasp-like device so that it may be swung out of position to permit the U-shaped body portion to receive a loop or chain link and into position across the U of the body to receive a securing device such as a padlock.

DESCRIPTION OF THE PREFERRED EMBODIMENT

Figure 1:
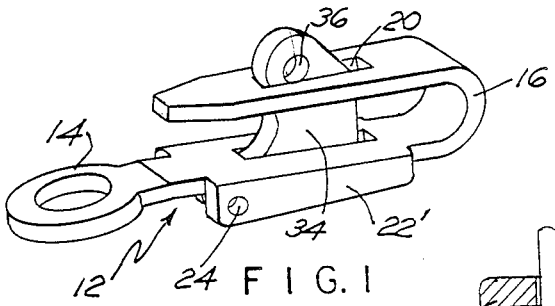
FIG. 1 is a perspective view of the device of my invention in a closed position.
Figure 3:
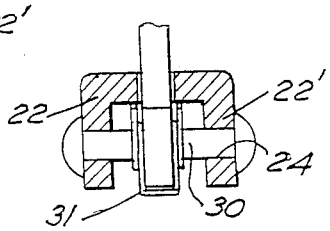
FIG. 3 is a sectional view taken on lines 3—3 of FIG. 2.

Referring to the drawings, it should be noted that the device of the invention consists essentially of three parts. One part, being designated generally 12, consists of an eye 14 which merges into a hasp-like or a hook body portion part which is a U shape being bent back upon itself to form a bight as at 16. The main body portion has two legs with slots completely therethrough there being a slot as at 18 and another slot substantially in registry therewith as at 20. Also, the body portion has a pair of ears 22—22' that are essentially enlargements that are formed away from the outer face of a leg of the body and these ears are pierced, as for example at 24—24', for the reception of a rivet such as 30.

Mounted in the body portion 12 is a bail or latch lug 34 which is pierced with an aperture as at 36 for the reception of a locking device, such as a padlock, and also at 37 where the lug receives a rivet 30. The latch lug also has an enlargement in the form of a pair of bent-out tabs 38 and 39 which are bent oppositely from the planar extent of the lug. These portions prevent the lug from being pulled upwardly through the slot 18.

Figure 2:
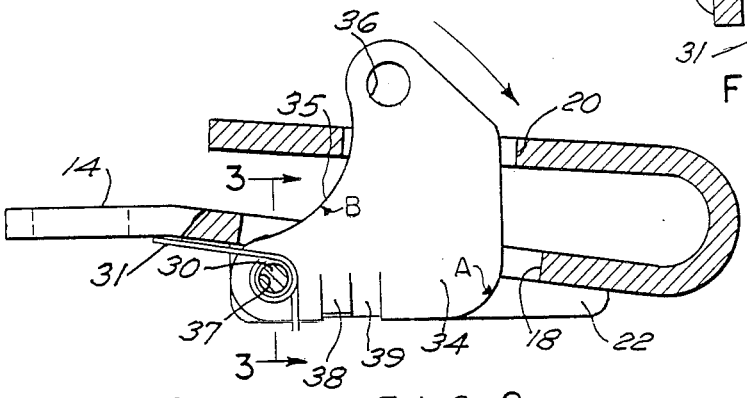
FIG. 2 is a side elevational thereof partly in section.

Other means may be utilized such as a dimple or protrusion. The bent out portions, or tabs, however are more practical since the tongue or latch lug 34 may very well be a hardened item which has been suitably heat treated and will be more effective. In addition, the dimensioning of the parts is such that the distance from A to B, as seen in FIG. 2, that it is greater than the width of the slot 20 so even if rivet 30 is punched out, the latch 34 will still extend across the hook of the hasp. For convenience of use the latch lug may have a torsion spring 31 acting against its lower surface to normally urge it upwardly as seen in the drawings.

In use, in order to secure a boat or the like to a dock or other fixed object, one of the devices of the invention may be securely fastened to the dock as for example at 40, where the eye 14 is riveted to a secure part of the dock and then a chain 42 may be provided which has been forged into the eye 14 of a second device which then may be passed through the eye 44 of a small boat. At the other end of the chain link, as at link 45, is then passed through the strap of the first device and secured with a padlock as at 46. Thus, by the utilization of two padlocks 46 and 46' which may conveniently be keyed alike, a boat is rather securely fastened and would need substantial bolt cutters in order to be used by an unauthorized person. It should also be noted that the surface 35 of the latch lug is arcuate and this shape permits the latch to be swung open against spring pressure, by the mere engagement of a ring or the like against the surface.

Figure 4A:
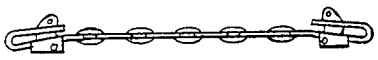
FIGS. 4, 4*a*, 4*b* and 4*c* are illustrative drawings showing various combinations using the device of my invention.
Figure 4:
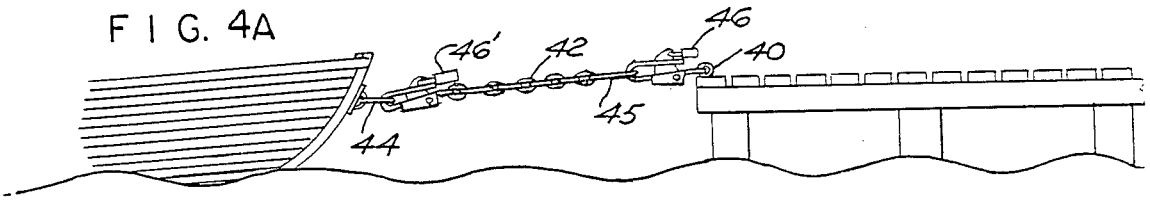
Figure 5:
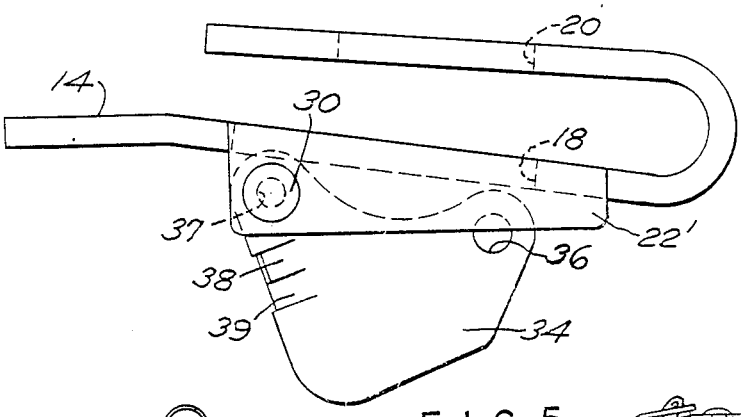
FIG. 5 is a side elevational view with the device of my invention in open position.
Figure 4B:
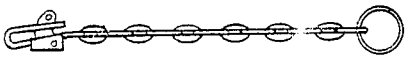
Figure 4C:
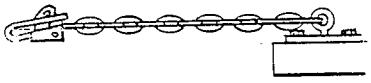

Other form are seen in FIG. 4*a* where a chain or other flexible strand is secured to the eyes of two hasps. The flexible strand can be passes about a pile, for example, then the bight may engage the strand while the other hasp is clipped on a bow ring. In FIG. 4*b* a large ring of a size to accept the hasp is secured on one end of a chain or the like with a hasp on the other end. To secure a pile, the chain is looped about the pile and the hasp is passed through the ring and then the hasp is secured to a bow ring on a boat. In FIG. 4*c* the hasp and chain are permanently secured to an eye that in turn is securely fastened to a fixed object.

I claim:

1. A device for securing valuable property such as a boat against unauthorized use comprising a hasp having a portion thereon bent into a U shape to form two legs, said hasp having at one end thereof an eye, the legs of the U shaped portion having slots passing completely therethrough and in substantial alignment, a latch lug pivoted to the body of the hasp to pass through the slots in the U-shaped portion of the hasp whereby the U-shaped portion of the hasp may engage chain links, loops of cable or the like to secure the property.

2. A device for securing property as in claim 1 wherein the latch lug has a locking aperture remote from the pivot and an enlargement on the outer face of one of the legs forms an anchor point for pivoting the latch lug.

3. A device as in claim 1 wherein one end of a flexible hardened strand is affixed to said eye.

4. A device as in claim 1 wherein a spring is provided urging the latch lug into position across the hasp.

5. A device as in claim 3 wherein the flexible strand has the eye of another hasp affixed thereto.

6. A device as in claim 3 wherein the other end of the strand has a large ring of a size to accept the hasp therethrough.

* * * * *